US005246230A

United States Patent [19]

McLellan

[11] Patent Number: 5,246,230

[45] Date of Patent: Sep. 21, 1993

[54] SELF-LIMITING SINGLE PLAYER GAME

[76] Inventor: Michael E. McLellan, 8807 Lowell, Overland Park, Kans. 66212

[21] Appl. No.: 914,311

[22] Filed: Jul. 17, 1992

Related U.S. Application Data

[63] Continuation of Ser. No. 689,488, May 17, 1981, abandoned.

[51] Int. Cl.[5] ..... A63F 9/08

[52] U.S. Cl. ..... 273/153 J; 273/275

[58] Field of Search ..... 273/153 J, 255, 262, 273/272, 258, 275, 260, 267, 243

[56] References Cited

U.S. PATENT DOCUMENTS

| | | | |
|---|---|---|---|
| 471,666 | 3/1892 | Doty | 273/275 |
| 1,068,449 | 7/1913 | Reeder | 273/153 J |
| 3,792,866 | 2/1974 | Dreyer et al. | 273/275 |
| 4,448,423 | 5/1984 | Augusta | 273/272 |
| 4,896,889 | 1/1990 | Kuhn | 273/272 |
| 4,934,711 | 6/1990 | Runstein | 273/272 |
| 5,058,896 | 10/1991 | Bez | 273/275 |

FOREIGN PATENT DOCUMENTS

| | | | |
|---|---|---|---|
| 2151592 | 4/1973 | Fed. Rep. of Germany | 273/153 J |

OTHER PUBLICATIONS

No. 333 Marble Solitaire, Mar. 1970 Toy Fair, p. 10.

No. 650 Far East Checkers "Chinese Checkers", Mar. 1970 Toy Fair, p. 10.

*Primary Examiner*—V. Millin

*Assistant Examiner*—S. Wong

*Attorney, Agent, or Firm*—Arvid V. Zuber

[57] ABSTRACT

A single player game combining chance and strategy comprised of a field of play comprised of 100 positions in 10 rows and 10 columns, a set of 75 markers comprised of 6 subsets, the markers in each subset being coded to indicate permissible placements on the positions in the field, the subset sets being comprised of a first subset of 30 markers, a second subset of 30 markers, a third subset of 5 markers, a fourth subset of 5 markers, a fifth subset of 4 markers and a sixth subset of 1 marker along with means for random selection, marker by marker, as each individually selected marker is placed in one of its permissible positions on the field, the game being concluded when all of the markers have been placed in the field or when there is no permissible placement in the field of the last marker selected.

7 Claims, 1 Drawing Sheet

SELF-LIMITING SINGLE PLAYER GAME

BACKGROUND

This is a continuation of copending application Ser. No. 689,488 filed May 17, 1991 now abandoned. The present invention is for a single player game combining chance and strategy in which the object is to play all of a set of markers according to the rules governing permissible placement of the markers on a field of play.

Single player games have long been known the most common being those played with a deck of cards and known as "Solitaire" or "patience". Such games are a useful pastime providing an intellectual challenge without being so demanding that the player loses interest through repeated failure to accomplish the goals of the game. It is also desirable that such games have some partial measure of success short of "winning the game". In solitaire the measure is the number of cards left unplayed; similarly, in the present game partial success is measured by the number of markers played or left unplayed.

BRIEF SUMMARY OF THE INVENTION

This invention is a single player game combining chance and strategy comprised of a field of play comprised of 100 positions in 10 rows and 10 columns, a set of 75 markers comprised of 6 subsets, the markers in each subset being coded to indicate permissible placements on the positions in the field, the subsets being comprised of a first subset of 30 markers, a second subset of 30 markers, a third subset of 5 markers, a fourth subset of 5 markers, a fifth subset of 4 markers and a sixth subset of 1 marker, along with means for random selection, marker by marker, as each individual marker is placed in its permissible position or positions in the field, the game being concluded when all of the markers have been placed on the field or when there is no permissible placement in the field for the last marker selected.

Thus the invention is for a single player game comprised of: A field of play comprised of 100 positions arranged in 10 rows and 10 columns; a set of 75 markers comprised of 6 subsets each subset being coded according to permissible placement of the markers in that subset on a position in the field of play, the six subsets being comprised of a first set of 30 markers, a second subset of 30 markers, a subset of 5 markers, a second subset of 5 markers , a subset of 4 markers, and a subset of 1 marker, and, means for random selection, marker by marker, from the set.

BRIEF DESCRIPTION OF THE DRAWINGS

In the drawings FIG. 1 represent the field of play.

PREFERRED EMBODIMENT

Figure 1:
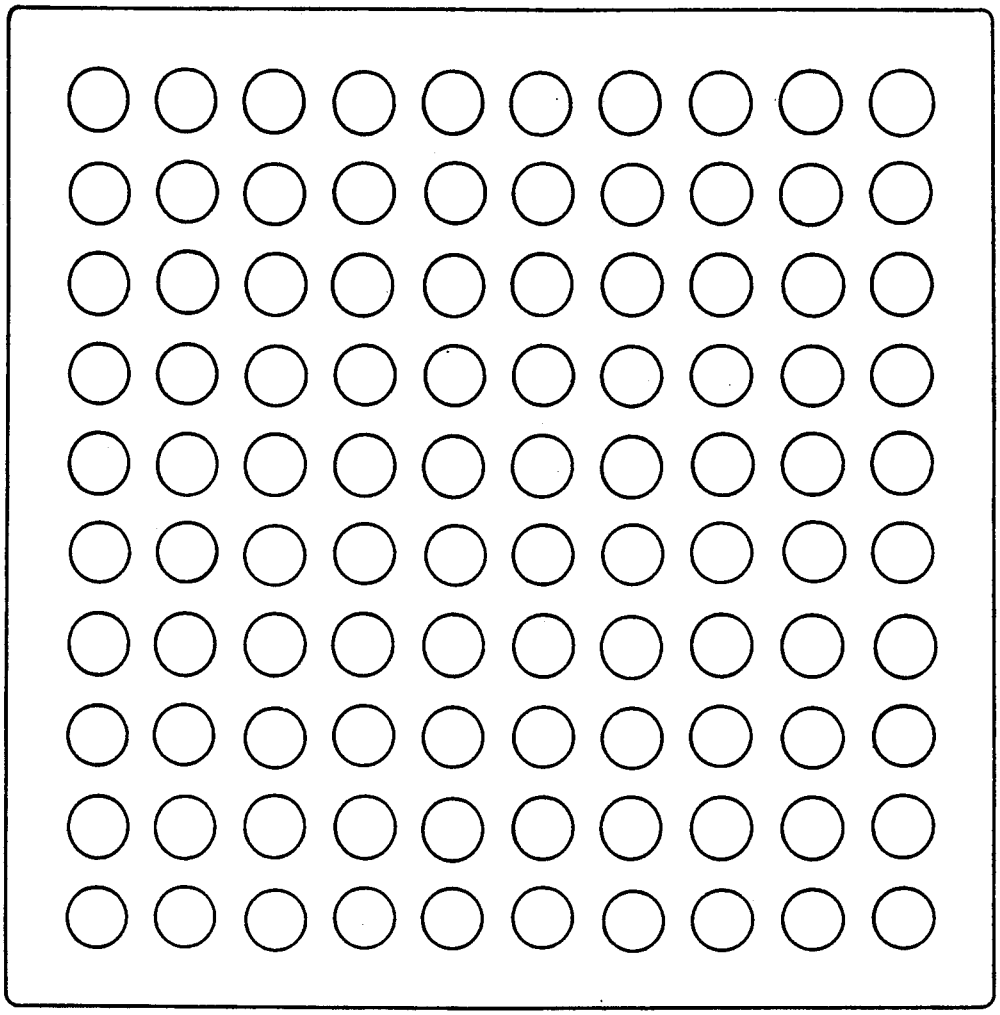
Figure 2:
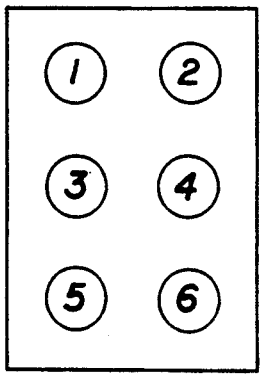
FIG. 2 represents a sample of each subset coded according to the subset code: code ∫1" indicating a member of the first subset of 30 markers, code "2" indicating a member of the second subset of 30 markers, code "3" indicating a member of the first subset of 5 markers, code "4" indicating the second subset of 5 markers, code "5" indicating a member of the subset of 4 markers and code "6" the member of the sixth subset of 1 marker.
Figure 3:
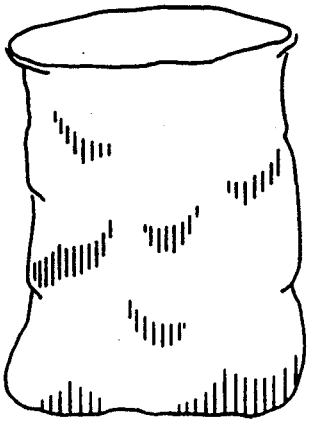
FIG. 3 represents a preferred means of random selection where the markers are drawn, at random, from a bag.

In a preferred embodiment the field of play is a board with the 100 positions marked by circular depressions in the board, the markers are marbles and the subsets are coded by the color of the marbles, for example, the 30 marbles in the first subset are black, the 30 in the second subset are clear, the 5 in the third subset are yellow, the 5 in the fourth subset are white, the 4 in the fifth subset are blue and the 1 in the sixth subset is red, and, the marbles are drawn at random from a bag.

The game is begun by drawing a marble, at random, from the bag and placing it on any position on the board. The second marble drawn is placed on any open position adjacent to the first marble; the first two marbles establish the direction of the initial line for play or placement of the subsequent marble(s). all marbles drawn after the first marble are played according to the following rules.

The first subset, black marbles, may be placed on any open position adjacent to a preceding black marble but only directly ahead of a marble from any other subset.

The second subset, clear marbles, may be placed on any open position adjacent to a preceding clear marble but only directly ahead of a marble from any other subset.

The third subset, yellow marbles, may be placed on either side but not ahead of the preceding marble, and, upon placement assumes the color or code of the preceding marble for purposes of the next marble played, but only for that next play. If the marble preceding the yellow marble is black and the marble drawn after the yellow marble is black then, the yellow marble having assumed the color of the preceding marble, black, the black marble following the yellow marble may be played in any open space adjacent to the yellow marble as though the yellow marble were black. However, thereafter the yellow marble becomes neutral.

The fourth subset, white marbles, may be placed in any open position adjacent to the prior marble, that is, on either side or ahead of the last placed marble, and, upon placement assumes the color or code of the preceding marble but only for purposes of the next marble played. Thereafter, the white marble, like the yellow, becomes neutral.

The fifth subset, blue marbles, may be placed on any open position adjacent to the prior marble. Once placed any permissible subsequent marble may be placed on any open position adjacent to the prior marble, that is, on either side or ahead of the blue marble (fifth subset). The permissible marbles for play off of a blue marble are the members of subset 1, black marbles, subset 2, clear marbles, subset 5, blue marbles, and subset 6, the red marble. A member of subset 3, yellow marbles and a member of subset 4, white marbles, cannot be played following a blue marble and must be returned to the unplayed marbles in the bag and another marble drawn.

The sixth subset, a red marble, may be placed on any open position of the board, and on placement may be used to establish a new line of direction of play of the subsequent marble(s). The first time the member of subset 6, the red marble, is drawn it may be returned to the unplayed marbles in the bag. The second time it is drawn it must be played.

All marbles (subsets) except the red marble (sixth subset) must be placed immediately in front of or on either side of the last-placed marble as the rules for the respective subsets dictate except when certain combinations arise between the last-played marble and an adjacent marble in a prior line of play. These combinations may arise through an adjacent and parallel prior line of play or when a line of play perpendicular to a prior line of play meets the prior line of play. When the last marble played and the marble in the prior line of play "match" and the next marble drawn is a further "match" then the line of play may cross, "jump", the "matching" marble in the prior line of play. The simplest "match" is where the last-played marble is black, the adjacent marble in the prior line of play is black and the next marble drawn is black. The same is true for a sequence of three clear marbles. However, the match may be more complex because of the properties of yellow marbles (subset three), white marbles (subset four), blue marbles (subset five) and the red marble (subset six). Both yellow marbles (subset three) and white marbles (subset four) become neutral after a marble following either one is played. Consequently a jump sequence may be black-yellow-black, clear-yellow-clear, black-white-black, or clear-white-clear. Because of their special characteristics blue marbles (subset five) and red marbles (subset six) may substitute for a black marble (subset one) or a clear marble (subset two) at either end of the jump sequence, for example; blue-black-black, blue-yellow-black, black-black-blue, or black-yellow-blue are permissible jump sequences. Similar sequences are permissible with clear marbles and for sequences where a red marble takes the place of a blue marble in the above-described jump sequences.

The well-known laws of probability make apparent the purposes of the sizes and codes of the six subsets in the play of the game. The set of 75 markers is comprised of six subsets which, collectively, comprise the set of 75 markers. The game also includes means for random selection one by one of the markers from the set. The six subsets are each coded to identify the members of each subset and to invoke the rules of the game governing the permissible placements of the members of each subset relative to its subset and to the other subsets. The 1st and 2nd subsets, as previously set forth, invoke rules of play with only minor restrictions on the placement of the markers of these two subsets relative to each other and to the markers of the other subsets. Each of these two subsets contains 30 markers; that is, together, they include 60 of the 75 markers of the complete set. This means that the chance of drawing a member of the 1st or 2nd subsets on the first draw if 60 out of 75 or 4 in 5 and that after the first draw the probability of drawing the next marker from either of these two sets falls to no more than 59 in 74 which is not significantly different from 4 in 5. In fact, even if all of the first thirty markers are drawn from the 1st and 2nd subsets the probability of the next marker being drawn from one or the other of these subsets is still 30 in 45 or 2 out of 3. Thus, according to the laws of probability, the size of these two subsets assures that play will be dominated by these two subsets for the purpose of permitting reasonable periods of play without undue interruption of the player's strategic placements of the markers as drawn. The 3rd, 4th, 5th, and 6th subsets are respectively, 1/12, 1/12, 1/15th and 1/60th of the combined sizes of the 1st and 2ne subsets thus assuring by the laws of probability that the rules of placement invoked by these subsets do not dominate the play of the game. Further, the members of the 3rd subset serve the purpose of invoking a rule requiring that the markers of this subset be placed on either side but not ahead of the preceding marker thereby, mandating by chance, a change in the direction of play; members of the 4th subset invoke a rule permitting placement of the marker on any open position adjacent to the preceding marker, the purpose being to allow the player maximum flexibility in the placement of the marker to pursue a strategic plan or escape from an impending untenable position subject to the limitations imposed by the code of the preceding marker; the members of the 5th subset invoke a rule that the marker drawn may be placed on any open position adjacent to the preceding marker but the rules governing the placement of subsequent markers adjacent to the markers from the 5th subset prohibit immediately subsequent play of markers from the 3rd and 4th subsets thereby eliminating the manifest complexity of play that would ensue from such a sequence of markers, if permitted. The single member of the 6th subset invokes the rule that his marker may be placed on any open position on the field of play the purpose of this single marker being to provide a rare chance to escape an untenable position including the opportunity of starting a new and independent direction of play. Further, since the rules invoked by the 4th through the 6th subsets, which have a lesser probability of coming into play relative to the 1st and 2nd subsets, provide a mix of permissive and mandatory placements these subsets add variety as well as chance to the game.

It may also be noted that since the field of play is comprised of 100 positions in 10 rows and 10 columns the field of play is a square field thereby providing an equal range of play in both dimensions thus avoiding the directional restrictions arising from an unbalanced field of play.

As will be readily recognized, any set of markers with similar solid geometrical shapes may be used when the markers are drawn, blindly, from a sack or other container. Dissimilar shapes may be used when other methods of random selection, or delivery of the markers are utilized, as, for example, delivery mechanisms where markers are delivered one by one on depression of a lever or, slide, one by one, down a shute with only the first marker in the train of the shute being visible. Where titles or other flat markers are used the 100 positions, conveniently, are set off by squares, which may have contiguous edges.

It will also be recognized that the game can be embodied within a computer program where the field of play is displayed on the screen and the program contains the necessary coding of the subsets, random selection of the markers and means for positioning the markers, directly, or through ancillary equipment such as a "mouse".

What is claimed is:

1. A self-limiting single player game combining chance and strategy played by random selection one by one or markers from a coded set of markers where the code on a marker invokes the rules of determining permissible placements of that marker adjacent to the other coded markers of the set wherein the set of markers is divided into six subsets each subset being coded to invoke the rules of placement governing the markers from that subset, where the strategic aspects of the game are enhanced by the size of the 1st and 2nd subsets which invoke rules permitting relatively unrestricted placement of the markers relative to the members of the same subset, each of these subsets being at least six times as large in number as any of the other four subsets and in the aggregate at least twelve times as large as any of the other four subsets with the object of assuring, according to the laws of probability, that the play of the game is dominated by the members of these two subsets, and the principle elements of chance are provided by the members of the 3rd, 4th, 5th and 6th subsets which are respectively: 1/12th, 1/12th, 1/15th and 1/60th of the size of the combined size of sets 1 and 2 with the object of assuring a significant probability that the rules governing the placement of these markers will not be invoked so often as to make chance the dominate element of the game and to provide by these four subsets each invoking its own rules the application of diverse rules encompassing both restrictive and permissive placement of the markers in these four subsets relative to each other and to the members of subsets 1 and 2 according to the rules invoked by the members of these four subsets thereby adding variety as well as chance to the enjoyment of the game, the game being played on a square field of play for the purpose of providing equal opportunity of play in two dimensions with the field of play being sized relative to the total number of markers in the set so as to restrict continuous play in any one direction consisted of:

a square field of play consisted of 100 separately spaced positions arranged in 10 rows and 10 columns, and a set of 75 markers consisted of the following six subsets the members of each subset being coded to invoke the rules governing permissible placement of the members that subset adjacent to the other markers of the set on the field of play:

a 1st subset consisted of 30 markers a 2nd subset consisted of 30 markers a 3rd subset consisted of 5 markers a 4th subset consisted of 5 markers a 5th subset consisted of 4 markers a 6th subset consisted of 1 marker, and means for random selection, marker by marker, from the set.

2. The game of claim 1 wherein the field of play is a board, all markers have the same solid geometrical shape and size and the means of random selection is a blind draw from a container.

3. The game of claim 1 wherein the field of play is a board, all markers have the same solid geometrical shape and size and the means of random selection is a blind draw from a sack.

4. A self-limiting single player game combining chance and strategy played by random selection one by one of a marker from a coded set of markers where the code on a marker invokes the rules determining permissible placements of that marker adjacent to the other coded markers of the set wherein the set of markers is divided into six subsets each subset being coded to invoke the rules of placement governing the markers from that subset, where the strategic aspects of the game are enhanced by the size of the 1st and 2nd subsets which invoke rules permitting relatively unrestricted placement of the markers of the same subset each these subsets being at least six times as large in number as any of the other four subsets with the object of assuring, according to the laws of probability, that the play of the game is dominated by the members of these two subsets, and the principle elements of chance are provided by the members of the 3rd, 4th, 5th an 6th subsets which are respectively: 1/12th, 1/12th/,1/15th and 1/60th of the combined size of sets 1 and 2 with the object of assuring a significant probability that the rules governing the placement of these markers will not be invoked so often as to make chance the dominate element of the game and to provide by these four subsets each invoking its own rules the application of diverse rules encompassing both restrictive and permissive placement of the markers in these four subsets relative to each other and to the members of subsets 1 and 2 according to the rules invoked by the members of these four subsets thereby adding variety as well as chance to the enjoyment of the game, the game being played on a square field of play for the purpose of providing equal opportunity in two dimensions with the field of play being sized relative to the total number of markers in the set so as to prohibit continuous play in any one direction consisted of:

a field of play consisted of 100 positions, each position being marked by a depression, arranged in 10 rows and 10 columns a set of markers consisted of 75 marbles of six different colors in 6 subsets, the marbles of each subset being of the same color, the color of each subset serving as a code to indicate permissible placements of the marbles of that subset adjacent to the other marbles in the set as determined by the codes of the other marbles, on the field of play as follows:

a subset of 30 marbles of a first color a subset of 30 marbles of a second color a subset of 5 marbles of a third color a subset of 5 marbles of a fourth color a subset of 4 marbles of a fifth color a subset of 1 marble of a sixth color means for random selection, marble by marble, from the set.

5. The game of claim 4 wherein the depression is a circular depression and the means of random selection is a container for blind draw, marble by marble.

6. The game of claim 4 wherein the depression is a circular depression and the means for random selection is a bag for blind draw, marble by marble.

7. The method of playing a self-limiting single player game played by random selection, on by one, of a marker selected from a coded set of markers where the code on the marker determines the permissible placements, according to the specific rules of the game, of the marker adjacent to the other coded markers in the set comprised of the following steps:

a) providing a square field of play comprised of 100 positions in 10 rows and 10 columns, b) providing a set of 75 markers coded in six subsets to define permissible placements of the markers of each subset adjacent to the other markers of the set as determined by the codes of the markers, comprised of a 1st subset of 30 markers a 2nd subset of 30 markers a 3rd subset of 5 markers a 4th subset of 5 markers a 5th subset of 4 markers a 6th subset of 1 marker c) providing a means of random selection, one by one, of the markers, d) selecting a first marker and placing the marker on the field of play, e) drawing a second marker and placing the second marker adjacent to the first marker thereby establishing a direction of play for subsequent markers, f) drawing subsequent markers and placing each subsequent marker adjacent to a prior placed marker in a position determined by the strategy of the player and the permissible placements of the marker as determine by the code of the marker and the prior placed markers, according to the following rules:

i. markers from the 1st set may be placed in any open space alongside or directly ahead of the other markers of the 1st set but only in an open space directly ahead of the markers from the 2nd set, ii. members from the 2nd set may be placed in any open space alongside or directly ahead of the other markers from the second set but only in an open space directly ahead of the markers from the 1st set, iii. members of the 3rd set may be placed in any open space on either side but not ahead of the preceding marker, and upon placement assume the code of the subset of the preceding marker for purposes of the next marker played, but only for that next marker, iv. members of the 4th subset may be placed in any open space adjacent to the last placed marker, and upon placement assume the code of the subset of the preceding marker for purposes of the next marker played, but only for that next marker, v. members of the 5th subset may be placed on any open space adjacent to the last placed marker; the only markers that can be played following the play of a marker form the 5th subset are the markers from the 1st, 2nd, 5th and 6th subsets any of which can be placed on any open space adjacent to a marker from the 5th subset, but markers from the 3rd and 4th subsets, if drawn immediately after a marker from the 5th subset has been played must be returned to the markers remaining to be played, vi. the single marker in the 6th subset may be placed on any open space on the board and may be used to start a new direction of play, vii. after the first marker drawn all markers, with the exception of the single marker in the 6th subset, must be played, adjacent to the last marker drawn according to the foregoing rules with the exception that when the last marker played in the ongoing line of play is adjacent to a marker in a prior line of play and the adjoining markers are such that if their sequence had been developed in the ongoing line of play the next drawn marker could have been played in that sequence then the next drawn marker may be played across the prior line of play as though the two adjacent markers were the ongoing line of play, g) continuing play until one of two outcomes is achieved the first outcome being the draw of a marker whose code permits no placement on an open position adjacent to a prior placed marker thus ending the game and the second outcome being the successful placement of all markers in the set on the field of play.

* * * * *